US006442872B1

(12) United States Patent
Liao

(10) Patent No.: US 6,442,872 B1
(45) Date of Patent: Sep. 3, 2002

(54) SHOE SPIKE ASSEMBLY HAVING CUSHIONING DEVICE

(76) Inventor: Canon Liao, 20F, No. 201, Sec. 1, Chong Gang Road, Taichung (TW), 403

( * ) Notice: Subject to any disclaimer, the term of this patent is extended or adjusted under 35 U.S.C. 154(b) by 0 days.

(21) Appl. No.: 09/814,913

(22) Filed: Mar. 23, 2001

(51) Int. Cl.[7] ..... A43C 15/00; A43B 5/00; A43B 23/28

(52) U.S. Cl. ..... 36/67 D; 36/134; 36/67 A; 36/59 B; 36/114

(58) Field of Search ..... 36/67 D, 134, 36/67 R, 67 A, 59 A, 59 B, 114, 212, 35 R, 36 B, 36 R, 37

(56) References Cited

U.S. PATENT DOCUMENTS

| | | | | | |
|---|---|---|---|---|---|
| 2,026,280 | A | * | 12/1935 | Kerin | 36/59 R |
| 2,911,738 | A | * | 11/1959 | Clerke | 36/134 |
| 3,133,364 | A | * | 5/1964 | Phillips | 36/59 R |
| 3,174,235 | A | * | 3/1965 | Johnston | 36/36 R |
| 3,178,835 | A | * | 4/1965 | Burje et al. | 36/36 R |
| 4,403,426 | A | * | 9/1983 | Kaplan | 36/36 B |
| 4,492,047 | A | * | 1/1985 | Arff | 36/134 |
| 4,644,672 | A | * | 2/1987 | Dassler et al. | 36/134 |
| 5,617,653 | A | * | 4/1997 | Walker et al. | 36/134 |
| 5,743,029 | A | * | 4/1998 | Walker et al. | 36/134 |
| 5,956,871 | A | * | 9/1999 | Korsen | 36/134 |

FOREIGN PATENT DOCUMENTS

| | | | | |
|---|---|---|---|---|
| WO | WO 88/06010 | * | 8/1988 | 36/35 R |
| WO | WO 94/09659 | * | 5/1994 | 36/134 |

* cited by examiner

*Primary Examiner*—Anthony D. Stashick
(74) *Attorney, Agent, or Firm*—Charles E. Baxley

(57) ABSTRACT

A spike includes an upper fastener for securing to a shoe sole, and includes a lower stem. A cap is attached to the stem. A cushioning pad is engaged between the cap and the spike, and/or another cushioning pad is engaged between the cap and the stem for cushioning and absorbing a shock and a vibration that may be transmitted from the cap to the spike or to the stem, and for preventing the users from being hurt by the shock and the vibration. The cap includes one or more catches for catching an enlarged head of the stem and for rotatably catching the cap to the stem.

3 Claims, 4 Drawing Sheets

SHOE SPIKE ASSEMBLY HAVING CUSHIONING DEVICE

BACKGROUND OF THE INVENTION

1. Field of the Invention

The present invention relates to a spike, and more particularly to a spike assembly for shoes or the like having a cushioning device for absorbing the shocks and vibrations that may be transmitted to the shoes.

2. Description of the Prior Art

Typical spikes for shoes are shown in FIGS. 1 and 2 and comprise a ring or a sleeve 4 engaged with the bottom of the shoe sole 2 of the shoe 1, and a spike body or a fastener 3 engaged through the sleeve 4 and threaded and secured to the shoe sole 2 for securing the fastener 3 and the sleeve 4 onto the shoe sole 2. The spikes have no cushioning device provided therein such that the shocks and the vibrations that may be transmitted to the shoes may be directly transmitted to the feet of the users.

The present invention has arisen to mitigate and/or obviate the afore-described disadvantages of the conventional spikes for shoes.

SUMMARY OF THE INVENTION

The primary objective of the present invention is to provide a spike assembly for shoes or the like including a cushioning device for absorbing the shocks and vibrations that may be transmitted to the shoes.

In accordance with one aspect of the invention, there is provided a spike assembly comprising a spike body including a fastener provided on top for attaching the spike body to a shoe sole, the spike body including a stem extended downward therefrom and having a lower end, a cap attached to the lower end of the stem, a first cushioning pad engaged between the cap and the spike body for cushioning and absorbing a shock transmitted from the cap to the spike body, and a second cushioning pad engaged between the cap and the lower end of the stem for cushioning a shock transmitted from the cap to the stem of the spike body.

A device may rotatably secure the cap to the stem and includes one or more catches for rotatably catching the cap to a lower head of the stem.

The cap includes a cavity formed therein for receiving the stem, the catch means includes at least one catch member extended inward of the cavity of the cap for engaging with the head of the stem. The catch member includes an inclined guiding surface for guiding the head of the stem into the cavity of the cap.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
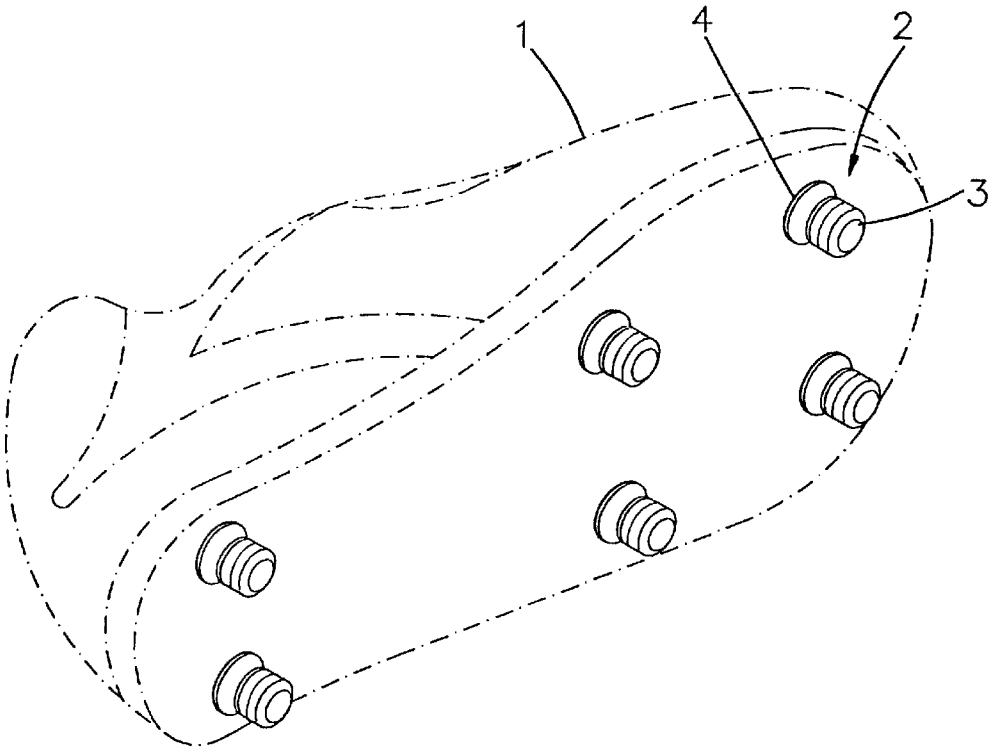
FIG. 1 PRIOR ART
FIG. 1 is a perspective view showing the attachment of the typical spikes to the bottom of a shoe member.
Figure 2:
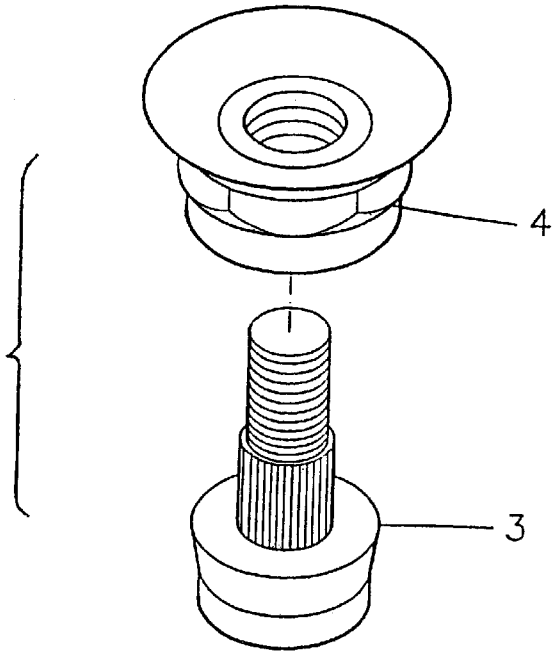
FIG. 2 PRIOR ART
FIG. 2 is an exploded view of the typical spike for the shoe.
Figure 4:
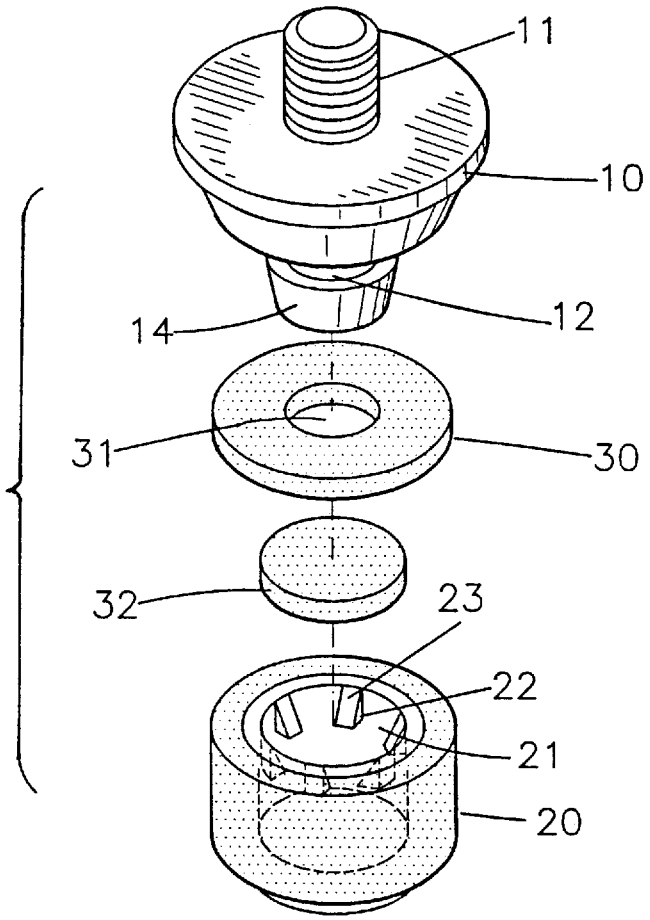
FIG. 4 is an exploded view of the spike assembly.
Figure 3:
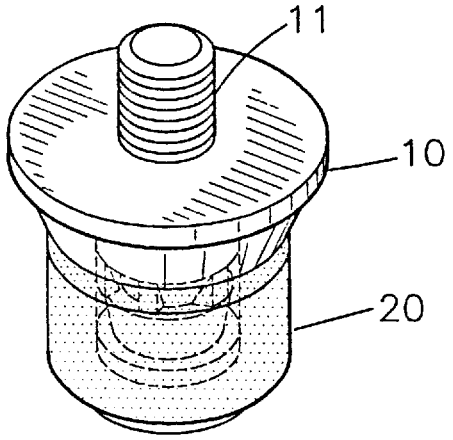
FIG. 3 is a perspective view of a spike assembly in accordance with the present invention.
Figure 5:
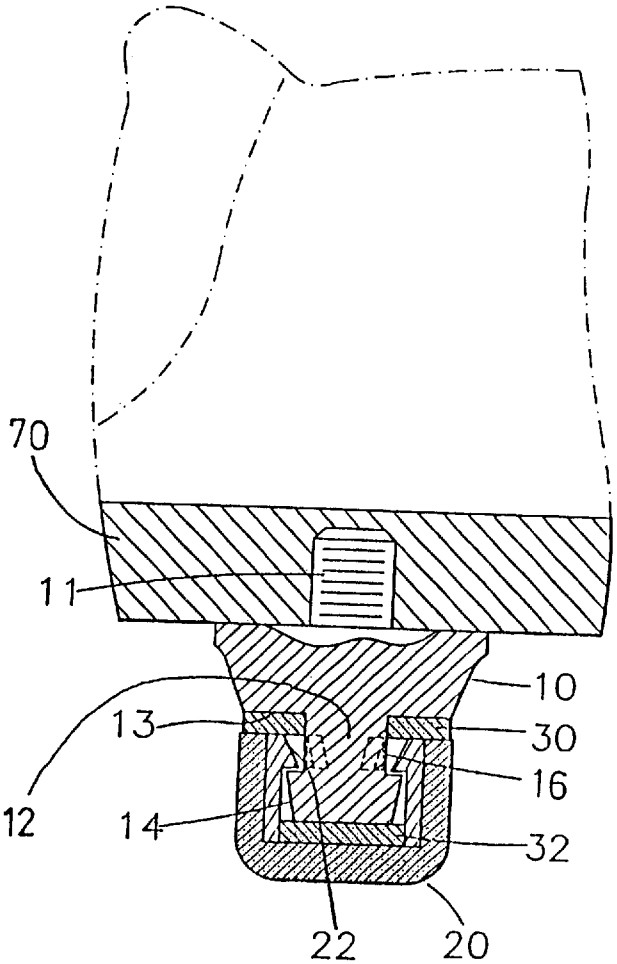
FIG. 5 is a cross sectional view illustrating the attachment of the spike assembly onto the bottom of the shoe sole.

Referring to the drawings, and initially to FIGS. 3–5, a spike assembly in accordance with the present invention comprises a spike body 10 including a fastener 11, such as a rivet, a snap-on clamp, a quick release catch, a bolt 11 or the like provided on the upper portion thereof for attaching and securing to the bottom of the shoe sole 70, and including a stem 12 extended downward therefrom and having an enlarged head 14 formed or attached or secured to the bottom end or the free end thereof. The stem 12 includes a diameter smaller than that of the spike body 10 for forming and defining a peripheral shoulder 13 between the stem 12 and the spike body 10. The enlarged head 14 includes a diameter greater than that of the stem 12 for forming and defining a peripheral groove 16 between the stem 12 and the spike body 10 and the head 14.

A ring-shaped cushioning pad 30 includes a bore 31 for receiving the stem 12 and for attaching onto the stem 12 and for engaging with the spike body 10. A cap 20 includes a blind hole or a cavity 21 formed therein for receiving the head 14 and the stem 12, and includes one or more ratchet-shaped catches 22 extended inward of the cavity of the cap 20 and each having a wedge-shape and each having an inclined guiding surface 23 formed in the upper portion thereof for guiding and for facilitating the engagement of the head 14 into the cavity 21 of the cap 20, and for rotatably securing the cap 20 to the stem 12 by the engagement of the catches 22 with the head 14 after the head 14 has been moved beyond the catches 22. Another cushioning pad 32 is engaged between the cap 20 and the head 14.

The cushioning pads 30, 32 are preferably made of soft or resilient materials, such as the plastic materials, rubber materials, synthetic materials, gel, or the like for absorbing the shocks and the vibrations that may be transmitted to the shoes, and for preventing the shocks and the vibrations from hurting the users. The pad 30 is engaged between the cap 20 and the spike body 10, and the pad 32 is engaged between the head 14 and the cap 20, such that the cushioning pads 30, 32 form in series a double layer cushioning structure for the spike assembly.

Figure 8:
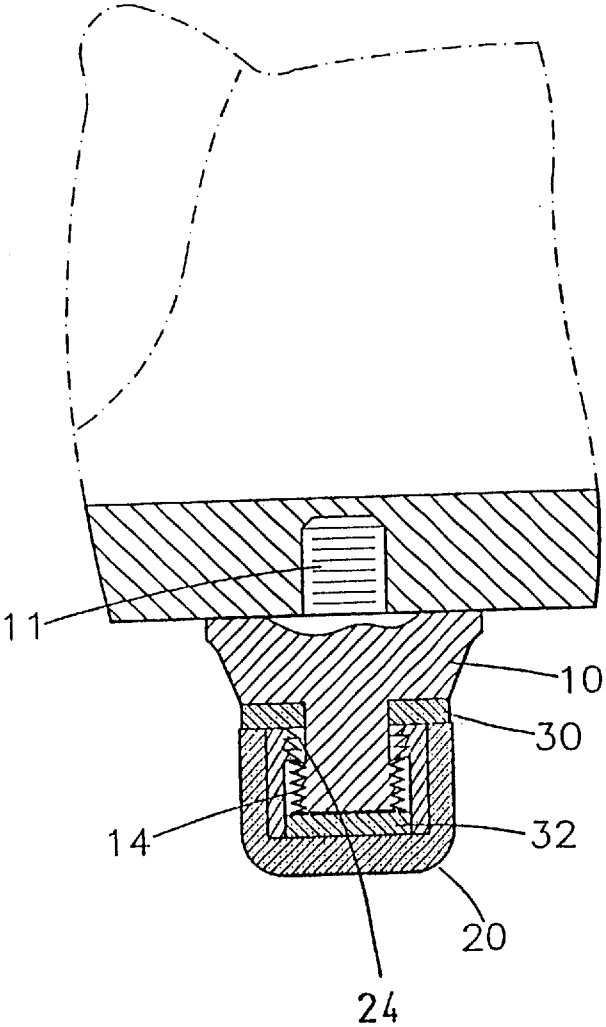
FIG. 8 is a cross sectional view illustrating the attachment of the spike assembly as shown in FIGS. 6 and 7 onto the bottom of the shoe sole.
Figure 7:
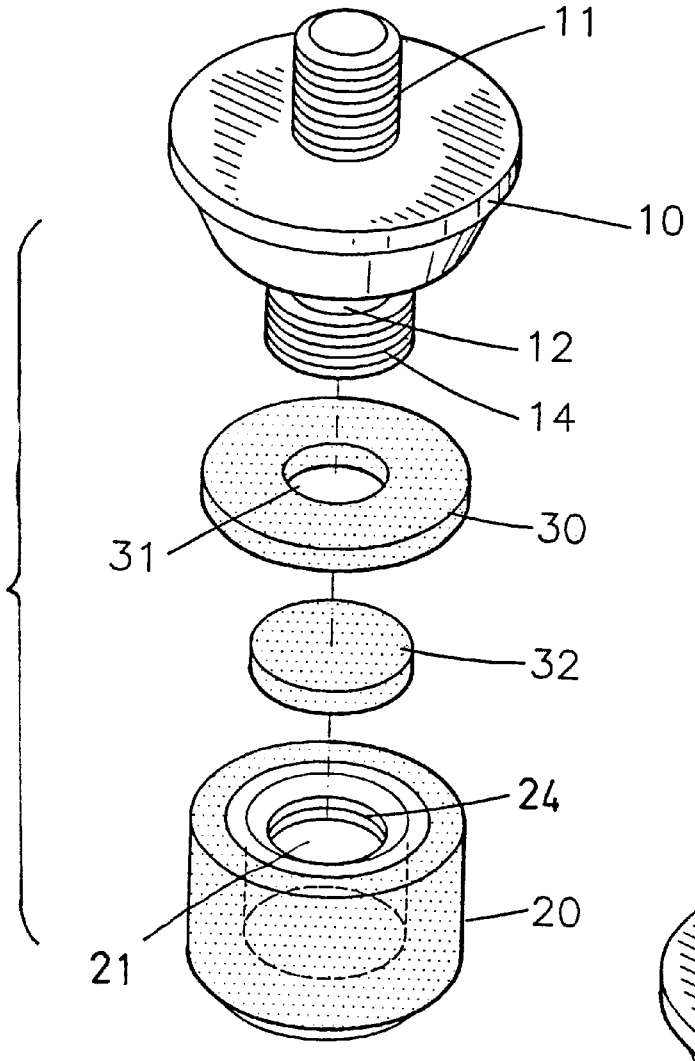
FIG. 7 is an exploded view of the spike assembly as shown in FIG. 6.
Figure 6:
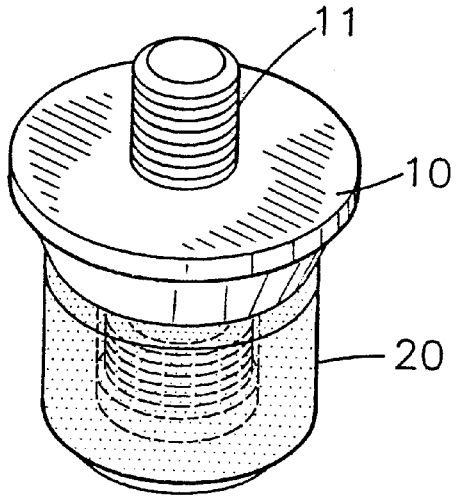
FIG. 6 is a perspective view showing the other embodiment of the spike assembly.

Referring next to FIGS. 6–8, instead of the catches 22, the head 14 may include an outer thread for threading with an inner thread 24 of the cap 20 and for securing the cap 20 to the spike body 10. The head 14 or the outer thread of the head 14 is preferably threaded beyond or disengaged from the inner thread 24 of the cap 20 and engaged into the cavity 21 of the cap 20 so as to be retained in the cap 20. The cushioning pads 30, 32 may also be formed as an excellent cushioning structure for the spike assembly.

Accordingly, the spike assembly for shoes includes a cushioning device for absorbing the shocks and vibrations that may be transmitted to the shoes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A spike assembly comprising:

a spike body including a fastener provided on top for attaching said spike body to a shoe sole, said spike body including a stem extended downward therefrom and having a lower end, said stem including a diameter smaller than that of said spike body for forming a peripheral shoulder between said stem and said spike body, said lower end of said stem including an enlarged head provided thereon, said head including a diameter greater than that of said stem for forming a peripheral groove between said stem and said head, a cap including a cavity formed therein for receiving said stem, and including a plurality of catch members extended inward of said cavity thereof for engaging with said head of said stem, said catch members each including an inclined guiding surface formed therein for guiding said head of said stem into said cavity of said cap and for allowing said catch members to be engaged into said peripheral groove of said stem, and for rotatably catching said cap to said head of said stem.

2. The spike assembly according to claim 1 further comprising a cushioning pad engaged between said cap and said spike body for cushioning and absorbing a shock transmitted from said cap to said spike body.

3. The spike assembly according to claim 1 further comprising a cushioning pad engaged between said cap and said head of said stem for cushioning and absorbing a shock transmitted from said cap to said stem of said spike body.

* * * * *